US006383699B1

(12) United States Patent
Yuh et al.

(10) Patent No.: US 6,383,699 B1
(45) Date of Patent: May 7, 2002

(54) PHOTORECEPTOR WITH CHARGE BLOCKING LAYER CONTAINING QUATERNARY AMMONIUM SALTS

(75) Inventors: Huoy-Jen Yuh, Pittsford; William W. Limburg, Penfield, both of NY (US)

(73) Assignee: Xerox Corporation, Rochester, NY (US)

( * ) Notice: Subject to any disclaimer, the term of this patent is extended or adjusted under 35 U.S.C. 154(b) by 0 days.

(21) Appl. No.: 09/768,772

(22) Filed: Jan. 24, 2001

(51) Int. Cl.[7] ..... G03G 5/10
(52) U.S. Cl. ..... 430/65; 399/38
(58) Field of Search ..... 430/65, 66; 399/38

(56) References Cited

U.S. PATENT DOCUMENTS

| | | | | |
|---|---|---|---|---|
| 4,133,684 A | | 1/1979 | Tarumi et al. | 96/1.5 R |
| 4,248,952 A | | 2/1981 | Paulin et al. | 430/62 |
| 4,515,882 A | | 5/1985 | Mammino et al. | 430/58 |
| 4,775,605 A | | 10/1988 | Seki et al. | 430/63 |
| 4,906,545 A | | 3/1990 | Fukagai et al. | 430/58 |
| 5,130,216 A | | 7/1992 | Koyama et al. | 430/59 |
| 6,261,729 B1 | * | 7/2001 | Yuh et al. | 430/65 |

* cited by examiner

*Primary Examiner*—John Goodrow
(74) *Attorney, Agent, or Firm*—Lahive & Cockfield, LLP

(57) ABSTRACT

This invention pertains to an electrographic photosensitive material comprising a blocking layer, an electroconductive substrate layer and a charge generation layer, where the blocking layer comprises $TiO_2$ with an average particle size less than about 50 nm and a quaternary ammonium salt, and where the quaternary ammonium salt is uniformly distributed in the blocking layer and is less than about 5 wt % of the blocking layer. In another aspect, this invention pertains to an image forming apparatus for forming images on a recording medium comprising an imaging light having a wavelength and an organic photoreceptor having a blocking layer, an electroconductive substrate layer, and a charge generation layer, where the blocking layer comprises $TiO_2$ particles and a quaternary ammonium salt, and where the quaternary ammonium salt is uniformly distributed in the blocking layer and is less than about 5 wt % of the blocking layer.

31 Claims, No Drawings

PHOTORECEPTOR WITH CHARGE BLOCKING LAYER CONTAINING QUATERNARY AMMONIUM SALTS

BACKGROUND OF THE INVENTION

This invention relates to an imaging member or photoreceptor which includes a blocking layer doped with quaternary ammonium salts containing long chain alkyl groups or polymeric structures to assist the transporting of photogenerated electrons.

An example of a photoreceptor that has been used as a drum or belt in electrophographic imaging systems includes a substrate, a conductive layer, a charge blocking layer, an adhesive layer, a charge generating layer, and a charge transport layer. For electrophotographic imaging systems which use uniform negative polarity charging prior to imagewise exposure it is the charge blocking layer that conducts off negative charge while preventing positive charge leakage. To avoid poor charge acceptance and high dark decay, the blocking layer must effectively block hole injection. To avoid high charge buildup at the charge blocking layer which results in low density in prints or printout defects (dark spots) in the background area under Discharge Area Development (DAD) scheme, the blocking layer must allow the passage of electrons. Conventional materials used in the charge blocking layer include: gamma-aminopropyltriethoxysilane, phenolic binder-titanium dioxide, polyvinylchloride-polyacrylonitrile emulsion, zirconium/siliane/partly hydrolyzed polyvinyl butyral, and nylon-terpolymer.

In organic photoreceptors, insulating polymers are commonly used as blocking layers. However, until now polymers with high enough electron transporting properties have not been developed. While insulating polymers can efficiently block hole injection from the underlying ground plane, their thickness is limited because they are ineffecient at transporting photoinjected electrons from the charge generation layer to the substrate layer. To limit its resistivity an insulating polymer charge blocking layer must be thin. The use of a thin charge blocking layer results in the problem of incomplete coverage of the underlying substrate due to inadequate wetting on localized unclean substrate surface areas. This leads to charge leakage. In particular, thin blocking layers are more susceptible to the formation of pinholes which allow positive charges to leak through the charge blocking layer and result in print defects including charge deficient spots (CDSs) and Bias Charge Roll (BCR) leakage breakdown. Further, thin charge blocking layers are more susceptible to contaminants which cause positive charges to pass through the charge blocking layer, thus resulting in charge deficient spots and creating copy print-out defects.

One approach to solve the problems associated with using insulating polymers in the charge blocking layer is to use a thick layer (i.e. 2 to 20 microns) of dispersed $TiO_2$ (an n-type semiconductor). Such a dispersed $TiO_2$ blocking layer can transport photogenerated electrons and eliminate the possibilities of pin holes arising from incomplete coverage of the substrate underlying the blocking layer. However, in order to coat the thick dispersed $TiO_2$ blocking layer, a dispersion of high solids content ($\geqq$30%) is required. In addition, a high loading of $TiO_2$ ($\geqq$70 weight % of total solid) is required in order to transport electrons efficiently at this thickness. The high solid content and high $TiO_2$ loadings very often cause pigment sedimentation and limit the dispersion pot life. Such requirements greatly limit the available binders and solvents for this application.

SUMMARY OF THE INVENTION

It is an object of the present invention to provide improved electrophotographic imaging members which overcome the above noted shortcomings of the prior art and to provide an improved electrophotographic imaging member having a blocking layer that has a uniform thickness.

It is a further object of the present invention to provide improved electrophotographic imaging members in which the blocking layer can be applied as a layer having a thickness of over 2 microns.

The present invention provides an improved electrophotographic imaging member having a hole blocking layer which suppresses the development of charge deficient spots associated with copy print-out defects.

Preferably, the present invention provides an improved electrophotographic imaging member having a hole blocking layer which suppresses the development of Bias Charge Roll (BCR) leakage breakdwon.

The resulting electrophotographic imaging member exhibits high quality imaging and printing characteristics.

Moreover, the blocking layer in the electrophotographic imaging member has a lower loading of $TiO_2$ than prior art blocking layers.

The electrophotographic imaging member in the present invention has a blocking layer formed from a dispersion of lower solids content than prior art blocking layers.

This invention pertains to an electrographic photosensitive material comprising a blocking layer, charge transport layer, an electroconductive substrate layer and a charge generation layer, where the blocking layer comprises $TiO_2$ with an average particle size less than about 50 nm and a quaternary ammonium salt, and where the quaternary ammonium salt is uniformly distributed in the blocking layer and is less than about 5 wt % of the blocking layer.

This invention also pertains to an electrographic photosensitive material comprising a blocking layer, where the blocking layer comprises $TiO_2$ with an average particle size of about 10 nm to about 300 nm, and a quaternary ammonium salt, and where the quaternary ammonium salt is greater than about 0.08 wt % and less than about 1 wt % of the blocking layer.

This invention encompasses the above-described electrographic photosensitive materials, where the $TiO_2$ comprises less than about 70 wt % of the total solids content of the blocking layer.

This invention includes the above-described electrographic photosensitive materials, where the quaternary ammonium salt is greater than about 0.08 wt % and less than about 0.1 wt % of the blocking layer.

In another aspect, this invention features the above-described electrographic photosensitive materials, where the quaternary ammonium salt is selected from the group consisting of salts containing long chain alkyl groups and salts containing polymeric structures.

Also within the scope of this invention are the above-described electrographic photosensitive materials, where the $TiO_2$ is rutile-type $TiO_2$.

In a further aspect, this invention includes the above-described electrographic photosensitive materials, where the blocking layer is in direct contact with the substrate layer.

This invention encompasses the above-described electrographic photosensitive materials, where the blocking layer further comprises a phenolic resin binder.

This invention also encompasses the above-described electrographic photosensitive materials, where the quaternary ammonium salt is Calgon 261-LV In an embodiment, this invention features the above-described electrographic photosensitive materials, where the quaternary ammonium salt is a methyltrialkyl ($C_8$–$C_{10}$)-ammonium halide.

This invention features the above-described electrographic photosensitive materials, where the methyltrialkyl ($C_8$–$C_1$)-ammonium halide is present in the blocking layer at a concentration of between about 400 and about 1000 ppm.

This invention further pertains to an image forming apparatus for forming images on a recording medium comprising an imaging light having a wavelength and an organic photoreceptor having a blocking layer, an electroconductive substrate layer, and a charge generation layer, where the blocking layer comprises $TiO_2$ particles and a quaternary ammonium salt and where the quaternary ammonium salt is uniformly distributed in the blocking layer and is less than about 5 wt % of the blocking layer.

This invention includes the above described image forming apparatus, where the $TiO_2$ in the blocking layer has a particle size smaller than about 10% of the wavelength of the imaging light.

This invention relates to the above described image forming apparatuses, where the quaternary ammonium salt is selected from the group consisting of salts containing long chain alkyl groups and salts containing polymeric structures.

In an embodiment, this invention pertains to the above described image forming apparatuses, where the $TiO_2$ comprises less than about 70 wt % of the total solids content of the blocking layer.

In one aspect, this invention includes the above described image forming apparatuses, where the quaternary ammonium salt is less than about 1 wt % of the blocking layer.

In another aspect, this invention includes the above described image forming apparatuses, where the quaternary ammonium salt is greater than about 0.8 wt % and less than about 1 wt % of the blocking layer.

One feature of this invention provides the above described image forming apparatuses, where the blocking layer is in direct contact with the substrate layer.

This invention also includes the above described image forming apparatuses, where the $TiO_2$ has an average particle size less than about 50 nm.

This invention further includes the above described image forming apparatuses, where the blocking layer further comprises a phenolic resin binder.

In another embodiment, this invention encompasses the above described image forming apparatuses, where the quaternary ammonium salt is Calgon 261-LV This invention also encompasses the above described image forming apparatuses, where the quaternary ammonium salt is a methyltrialkyl ($C_8$–$C_{10}$)-ammonium halide.

In another aspect, this invention also relates to the above described image forming apparatuses, where the methyltrialkyl ($C_8$–$C_{10}$)-ammonium halide is present in the blocking layer at a concentration of between about 400 and about 600 ppm.

DETAILED DESCRIPTION OF THE INVENTION

The invention relates to improved electrophotographic imaging members including organic photoreceptors with an improved charge blocking layer.

In an embodiment, the photoreceptor has a substrate, a conductive layer, a charge blocking layer, an optional adhesive layer, a charge generating layer, and a charge transport layer.

A preferred structure of the imaging member is as follows: a substrate having an electrically conductive surface, a blocking layer over the substrate conductive surface, a charge generating layer over the blocking layer, a charge transport layer over the charge generating layer. The imaging member may also include one or more additional layers typically employed in the photoreceptor including for example an adhesive layer, an anticurl layer, and an overcoat layer. In an alternate embodiment of the present invention, the charge transport layer is adjacent to the blocking layer with the charge generating layer over the transport layer.

Blocking Layer

The blocking layer is located between the substrate layer and the charge generation layer and contains a polymer and an inorganic pigment. The underlying conductive layer injects holes into the photoconductive layer due to the electrical field between the negative charges on the surface of the photoconductor and positive charges in the conductive layer after the charging process. The blocking layer forms an electronic barrier to prevent injection of holes into the adjacent photoconductive layer from the underlying conductive layer during the charge, image, and development cycles. The blocking layer also allows for the transport of photo-injected electrons from the charge generation layer to the substrate. If desired, an adhesive layer may be interposed between the blocking layer and the photoconductive layer to enhance adhesion. Preferably, however, the blocking layer is in direct contact with the substrate layer. As described below, the substrate layer may include a conductive layer.

Examples of the inorganic pigment used in the blocking layer include a pigment having a refractive index of not less than about 1.5 on the basis of visible radiation or near infrared radiation; such pigments may include titanium dioxide, zinc oxide, zinc sulfide, white lead, lithopone, and the like. Also included within the scope of this invention are pigments including $TiO_2$ and having a refactive index of less than 1.9.

Titanium oxides are classified into two groups, i.e. anatase type and rutile type. The present invention can use either rutile-type or anatase-type titanium oxides. Commercially available titanium oxides can be further classified into two types, one of which is surface-treated with a solution of hydrate oxide of Al and Si, and the other of which is not surface-treated. It is preferable for the present invention to use the latter type of titanium dioxide with no such surface treatment. A particular inorganic pigment is titanium oxide pigment without surface treatment, namely a titanium dioxide belonging to Anatase type Class I, the surface of which is not treated, as defined in JIS-K5116.

The refractive index of titanium oxide is relatively large, so that it is possible to effectively prevent the Moire fringe, which often occurs in the course of image recording by use of coherent light such as a laser beam.

The $TiO_2$ used in the present invention preferably has an average particle size less than about 50 nm. The $TiO_2$ used in the present invention desireably has an average particle size less than about 30 nm.

The dispersion used to coat the blocking layer has a solids content less than about 30 wt %. In another embodiment, the dispersion used to coat the blocking layer has a solids content less than about 25 wt %.

The $TiO_2$ itself preferably comprises less than about 70 wt. % of the total solids content of the dispersion used to coat the blocking layer. More preferably $TiO_2$ comprises less than about 50 wt % of the total solids content of the dispersion used to coat the blocking layer.

Other metallic oxides in the form of a powder may be added to any of the binder resins of the blocking layer.

Examples of such metallic oxides are $SnO_2$, $Sb_2O_3$, $In_2O_3$, $SiO_2$, $ZrO_2$ and $Al_2O_3$. These metallic oxides can be used alone or in combination. In a preferred embodiment, ZnO is used in the blocking layer. When such a metallic oxide powder is employed, the metallic powder is dispersed together with a solvent and a binder resin, for instance, in a ball mill, a sand mill or an attritor, thereby preparing a blocking layer formation liquid.

When the previously mentioned metallic oxides are employed in the blocking layer, it is preferable that the weight ratio of the metallic oxide to the binder resin be in a range of about 0.5/1 to about 3/1. It is most preferred that the ratio by weight of titanium oxide to binder resin be in the range of about 0.9/1 to about 2/1. When the weight ratio of titanium oxide to the binder resin is about 0.9/1 or more, the properties of the undercoat layer are not excessively influenced by the characteristics of the employed binder resin. In particular, it is possible to minimize the changes in photoconductive properties caused by the change in temperature and humidity or by repeated operations (i.e. of the photoreceptor). Further, when the weight ratio of titanium oxide to binder resin is about 2/1 or less, the number of voids formed in the blocking layer does not reduce adhesion between the blocking layer and the charge generation layer. When the weight ratio of titanium oxide to the binder resin is greater than about 3/1, air accumulates in the blocking layer, causing air bubbles in the charge transport layer formulation liquid during coating and drying of the charge transport layer formulation liquid. Thus, too much titanium oxide in the undercoat layer hinders the coating performance of the charge transport layer.

The mixing ratio of a polymer, inorganic pigment and binder varies depending on the materials used. However, it is generally preferable to use the inorganic pigment in an amount of about 0.05 to 10 parts by weight per one part by weight of the total amount of the electroconductive polymer and the binder if used.

The blocking layer may include the above-mentioned inorganic pigment and a binder (resin of low resistance) conventionally used. However, the binder should be capable of being dissolved in a solvent for the electroconductive polymer and not be attacked by a photosensitive layer-forming solution to be coated on the blocking layer. Examples of binders which satisfy these conditions include resins soluble in water or alcohol, such as polyvinyl alcohol, sodium polyacrylate, CMC, casein, sodium alginate, nylon, copolymerized nylon, alkoxymethylated nylon, and the like.

Other binder resins for use in the blocking layer are thermoplastic resins such as polyamide, polyester, vinyl chloride—vinyl acetate copolymer; and thermosetting resins which are prepared, for instance, by thermally polymerizing a compound having a plurality of active hydrogen atoms, for instance, such hydrogen atoms as in —OH group, —$NH_2$ group, and —NH group, and a compound having a plurality of isocyanate groups and/or a compound having a plurality of epoxy groups. Examples of the compound having a plurality of active hydrogen atoms are polyvinyl butyral, phenoxy resin, phenolic resin, polyamide, polyester, and acrylic resins with groups including active hydrogen atoms such as a hydroxyethyl methacrylate group. Examples of the compound having a plurality of isocyanate groups are tolylenediisocyanate, hexamethylene diisocyanate and diphenylmethane diisocyanate; and prepolymers thereof. Examples of compounds having a plurality of epoxy groups include diglycidyl-bisphenol-A, bisphenol A type epoxy resins, diglycidyl-1,2-cyclohexanedicarboxylate, 1, 4-cyclohexanedimethanol diglycidylether and tris(2, 3-epoxypropyl) isocyanurate.

Further examples of resins for use in the blocking layer are thermoplastic resins such as polyester, polycarbonate, polyvinyl butyral, polyamide, polystyrene, epon resins such as Epon 1007 and 1009 (products of Shell Chemical Company), polyurethane, polypropylene, polyacrylate, polyvinyl chloride, casein, and methoxyrnethylated nylon; thermosetting resins such as phenolic resin, melamine resin, epoxy resin, polyurethane, alkyd resin, phenolic resin, butyral resin, and unsaturated polyester resin; and photosetting resins. The above-mentioned resins can be used alone or in combination, and also can be employed in the form of a solution by dissolving them in solvents.

In a preferred embodiment, the blocking layer is doped with a quaternary ammonium compound as represented by Formula I

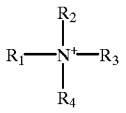

in which $R_1$, $R_2$, and $R_3$ are independently hydrogen, alkyl, alkenyl, alkynyl, aryl, alkylaryl, alkyl ester, alkyl covalently linked to a polymer, alkenyl covalently linked to a polymer, alkynyl covalently linked to a polymer, aryl covalently linked to a polymer, alkylaryl covalently linked to a polymer, or alkyl ester covalently linked to a polymer $R_4$ is alkyl, alkenyl, alkynyl, aryl, alkylaryl, alkyl ester, alkyl covalently linked to a polymer, alkenyl covalently linked to a polymer, alkynyl covalently linked to a polymer, aryl covalently linked to a polymer, alkylaryl covalently linked to a polymer, alkyl ester covalently linked to a polymer, covalently linked to $R_1$, $R_2$, or $R_3$ to form a ring, or covalently linked to $R_1$, $R_2$, or $R_3$ to form a ring which ring is covalently linked to a polymer.

Examples of suitable polymers for the quaternary ammonium compound are Calgon 261-LV, and Calgon 261-LV or Andogen 464 with added glycerine as a plasticizer and humectant.

In an embodiment of Formula I, the alkyl of $R_1$, $R_2$, $R_3$, and $R_4$ is a $C_6$–$C_{10}$ alkyl.

In another embodiment of Formula I, the ring is a 6-membered ring.

In a preferred embodiment of Formula I, the quaternary ammonium compound is a methyltrialkyl $C_6$–$C_{12}$ ammonium compound.

A particularly preferred quaternary ammonium salt is methyltrialkyl $C_8$–$C_{10}$ ammonium halide, i.e., Adogen 464 (methyltrialkyl $C_8$–$C_{10}$ ammonium chloride). In one embodiment, Adogen 464 is present in the blocking layer at a concentration of between about 100 and 1000 ppm. Alternatively, Adogen 464 is present in the blocking layer at a concentration of between about 400 and about 600 ppm. In a preferred embodiment, Adogen 464 is present in the blocking layer at a concentration of about 500 ppm.

Quaternary ammonium compounds may be represented by Formula II

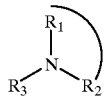

in which $R_1$ and $R_2$ are covalently linked to form a ring, which ring contains a double bond adjacent to nitrogen or covalently linked to form a ring, which ring contains a double bond adjacent to nitrogen and which ring is covalently linked to a polymer.

$R_3$ is hydrogen, alkyl, alkenyl, alkynyl, aryl, alkylaryl, alkyl ester, alkyl covalently linked to a polymer, alkenyl covalently linked to a polymer, alkynyl covalently linked to a polymer, aryl covalently linked to a polymer, alkylaryl covalently linked to a polymer, or alkyl ester covalently linked to a polymer.

In an embodiment of Formula II, the ring is a 6-membered ring.

In another embodiment of Formula II, the alkyl of $R_3$ is a $C_6$–$C_{10}$ alkyl.

Examples of quaternary ammonium compounds of Formulas I and II suitable for use in the present invention follow.

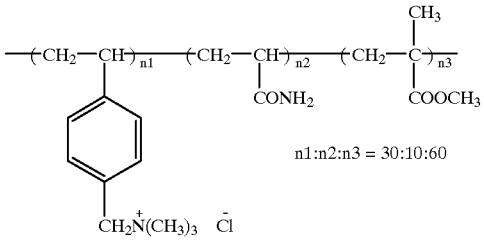

n1:n2:n3 = 30:10:60

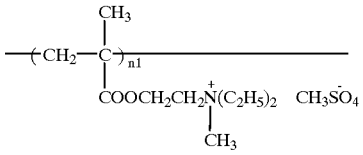

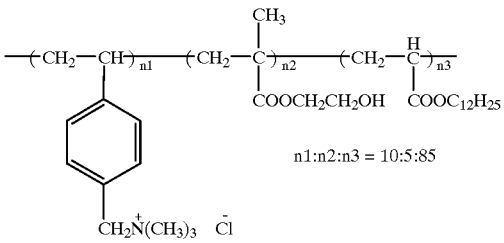

n1:n2:n3 = 10:5:85

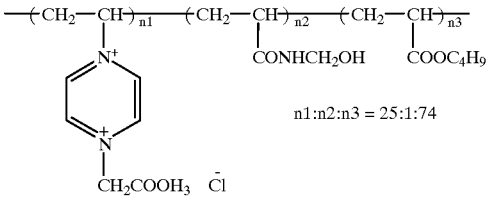

n1:n2:n3 = 25:1:74

-continued

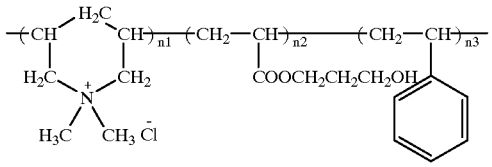

n1:n2:n3 = 35:10:55

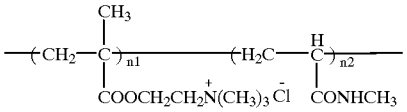

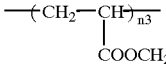

n2:n2:n3 = 40:0.5:59.5

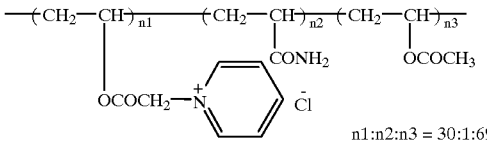

n1:n2:n3 = 30:1:69

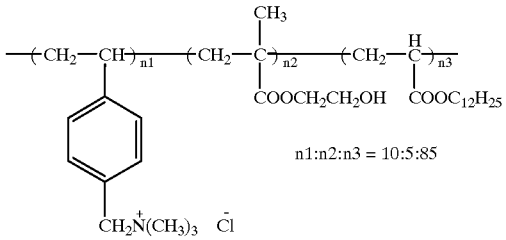

n1:n2:n3 = 10:5:85

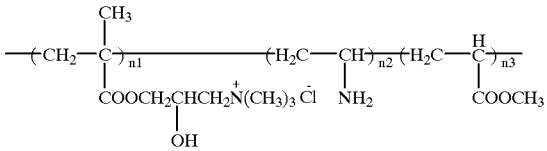

n1:n2:n3 = 15:15:70

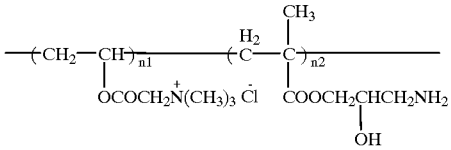

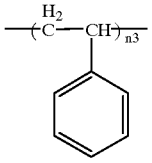

n1:n2:n3 = 30:10:60

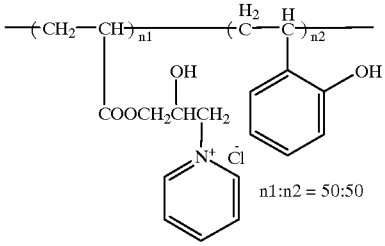

n1:n2 = 50:50

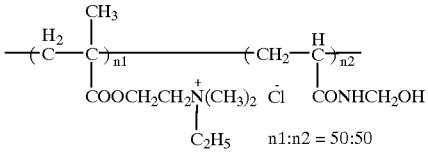

n1:n2 = 50:50

-continued

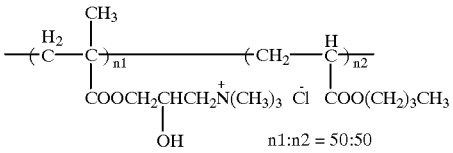

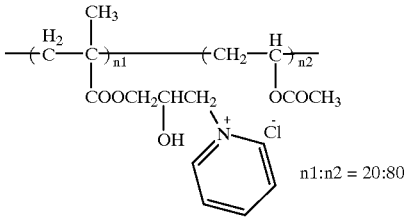

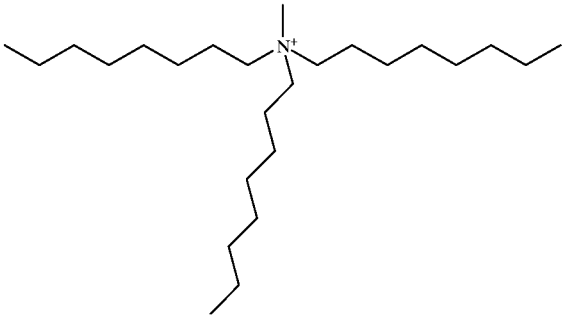

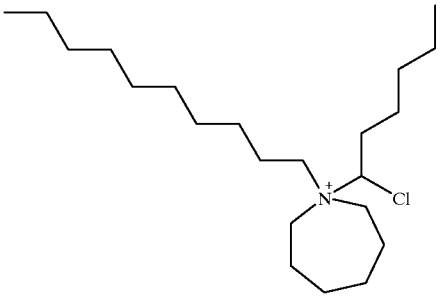

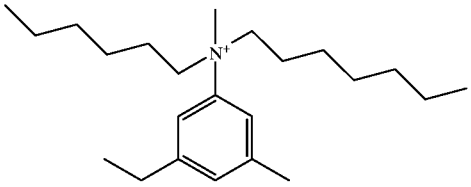

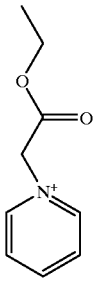

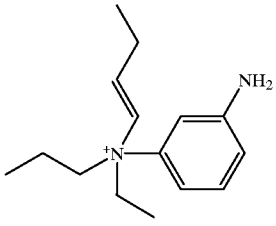

The advantages of using quaternary ammonium compounds in the blocking layers are they are compatible with the binder polymer because of their long alkyl chains. The compatibility produces a transparent blocking layer. The ammonium salts can also conduct electrons generated from the photogeneration process.

The quaternary ammonium compound may be present as a quaternary ammonium salt. In one embodiment, the quaternary ammonium salt is uniformly distributed in the blocking layer. The concentration of the quaternary ammonium salt in the blocking layer may range from about 0.01 to about 10 wt %. For example, the concentration of the quaternary ammonium salt in the blocking layer is less than about 5 wt %. In another example, the concentration of the quaternary ammonium salt in the blocking layer is less than about 1 wt %. In another embodiment, the concentration of the quaternary ammonium salt in the blocking layer is less than about 0.1 wt %. Preferably, the concentration of the quaternary ammonium salt in the blocking layer is greater than about 0.05 wt % and less than about 1 wt %.

In addition, the blocking layer may further comprise a silane coupling agent, a titanium coupling agent, a chromium coupling agent, a titanyl chelate compound, a zirconium chelate compound, a titanyl alkoxide compound, and an organic titanyl compound.

The blocking layer may be formed by dispersing the above mentioned inorganic white pigment, solvent, quaternary ammonium salt, and a binder in a ball mill, coating (i.e. by roll coating, dip coating, spray coating, immersion coating, nozzle coating, or blade coating) the resultant dispersion on a substrate layer, and drying and/or curing (i.e. at about 50° C. to about 200° C.) the substrate having the dispersion coated thereon. In a preferred embodiment, a Dowinol (Dow Chemical) and methanol solvent mixture, which may dissolve Adogen 464, is used for forming a $TiO_2$ dispersion to create the blocking layer. The blocking layer thus coated on the substrate generally has a thickness of about 0.3 to about 40 $\mu\mu$m. More preferably the thickness of the blocking layer is in a range of about 2 to about 20 $\mu$m. In a preferred embodiment, the blocking layer has a thickness of between about 3 and about 10 $\mu$m.

Substrate

The supporting substrate may be opaque or substantially transparent. The substrate may comprise any suitable materials having the required mechanical properties. Accordingly, the substrate may include a layer of an electrically non-conductive and/or conductive material. As electrically non-conducting materials there may be employed various resins known for this purpose including polyesters, polycarbonates, polystyrenes, polyimides, polyamides, polyurethanes, and the like. Typical conductive materials include, for example, aluminum, nickel, stainless steel, chromium, zirconium, titanium and the like.

The electrically insulating or conductive substrate may be flexible or rigid and may have any number of different configurations such as, for example, a sheet, a scroll, an endless flexible belt, and the like. For rigid substrates, the substrates may be a composite drum including a thermosetting or thermoplastic resin and a conductive dispersion of metal particles or, alternatively, a thermosetting or thermoplastic drum having a metal coating. Preferably, the substrate is in the form of a metal drum having a roughened surface. The surface may be roughened by any suitable technique such as grinding, grit blasting, sanding, and the like. If desired, however, the surface may be smooth.

The thickness of a flexible substrate support depends on numerous factors, including economical considerations, and thus this layer for a flexible belt may be of substantial thickness, for example, over about 200 micrometers, or of minimum thickness less than about 50 micrometers, provided there are no adverse affects on the final photoconductive device. In one flexible belt embodiment, the thickness of this layer ranges from about 65 micrometers to about 150 micrometers, and preferably from bout 75 micrometers to about 125 micrometers for optimum flexibility and minimum stretch when cycled around small diameter rollers, e.g. about 12 millimeter diameter rollers.

Conductive Layer

The conductive layer of the supporting substrate may comprise an electrically conductive material that extends through the thickness of the substrate or may comprise a layer or coating of electrically conducting material on the substrate. Where the entire substrate is electrically conductive, the outer surface performs the function of an electrically conductive layer, and a separate electrically conductive layer need not be added.

A conductive layer may vary in thickness over substantially wide ranges depending on the degree of optical transparency and flexibility desired for the electrostatographic imaging member. Accordingly, for a flexible imaging device, the thickness of the conductive layer may be between about 20 angstrom units to about 750 angstrom units, and more preferably from about 100 Angstrom units to about 200 angstrom units for an optimum combination of electrical conductivity, flexibility and light transmission. The flexible conductive layer may be an electrically conductive metal layer formed, for example, on the substrate by any suitable coating technique, such as a vacuum depositing or sputtering technique. Typical metals include aluminum, zirconium, niobium, tantalum, vanadium and hafnium, titanium, nickel, stainless steel, chromium, tungsten, molybdenum, and the like. The conductive layer need not be limited to metals. Upon exposure to the ambient atmospheric environment, most electrically conductive metal ground plane surfaces react with the atmospheric oxygen and spontaneously form a thin metal oxide layer on its surface.

In an embodiment, the conductive layer comprises a plurality of metal layers with the outermost metal layer (i.e. the layer closest to the charge blocking layer) including at least about 50 percent by weight of zirconium. At least about 70 percent by weight of zirconium is preferred in the outermost metal layer for even better results. The multiple layers may, for example, all be vacuum deposited or a thin layer can be vacuum deposited over a thick layer prepared by a different techniques such as by casting. Thus, as an illustration, a zirconium metal layer may be formed in a separate apparatus than that used for previously depositing a titanium metal layer or multiple layers can be deposited in the same apparatus with suitable partitions between the chamber utilized for depositing the titanium layer and the chamber utilized for depositing zirconium layer. The titanium layer may be deposited immediately prior to the deposition of the zirconium metal layer. Generally, for rear erase exposure, a conductive layer light transparency of at least about 15 percent is desirable. The combined thickness of the two conductive layers should be between about 120 and about 300 angstroms. A typical zirconium/titanium dual conductive layer has a total combined thickness of about 200 angstroms. Thicker layers may also be utilized, and economic and transparency considerations may affect the thickness selected.

Adhesive Layer

An optional adhesive layer may be applied to the blocking layer. Any suitable adhesive layer may be utilized. One well known adhesive comprises a polyester resin known as du Pont 49,000 (available from duPont de Nemours & Co.), a linear saturated copolyester reaction product of four diacids and ethylene glycol. The du Pont 49,000 linear saturated copolyester consists of alternating monomer units of ethylene glycol and four randomly sequenced diacids in the above indicated ratio and has a weight average molecular weight of about 70,000 and a Tg of about 32° C. If desired, the adhesive layers may comprise a copolyester resin such as, for example, Vitel PE-100, Vitel PE-200, Vitel PE-200D, and Vitel PE-222, all available from Goodyear Tire and Rubber Co. The adhesive layer including this polyester resin is applied to the blocking layer. Any adhesive layer employed should be continuous and preferably, have a dry thickness between about 200 micrometers and about 900 micrometers and more preferably between about 400 micrometers and about 700 micrometers. Any suitable solvent or solvent mixtures may be employed to form a coating solution of the polyester. Typical solvents include terahydrofuran, toluene, methylene chloride, cyclohexanone, and the like, and mixtures thereof. Any other suitable and conventional technique may be utilized to mix and thereafter apply the adhesive layer coating mixture of this invention to the charge blocking layer. Typical application techniques include spraying, dip coating, roll coating, wire wound rod coating, and the like. Drying of the deposited coating may be effected by any suitable conventional technique such as oven drying, infra red radiation drying, air drying and the like.

Charge Generation Layer

Any suitable charge generation layer may be applied to the blocking layer or intermediate layer if one is employed. Examples of charge generation layers include inorganic photoconductive particles such as amorphous selenium, trigonal selenium, and selenium alloys selected from the group consisting of selenium-tellurium, selenium-tellurium-arsenic, selenium arsenide and mixtures thereof, and organic photoconductive particles including various phthalocyanine pigment such as the X-form of metal free phthalocyanine described in U.S. Pat. No. 3,357,989, metal phthalocyanines such as vanadyl phthalocyanine and copper phthalocyanine, quinacridones available from E. I. duPont de Nemours & Co. under the tradenames Monastral Red, Monastral violet and Monastral Red Y, dibromo anthanthrone pigments (sold by E. I. duPont de Nemours & Co. under the tradenames Vat Orange 1 and Vat Orange 3), benzimidazole perylene, substituted 2,4-diamino-triazines disclosed in U.S. Pat. No. 3,442,781, polynuclear aromatic quinones available from Allied Chemical Corporation under the tradename Indofast Double Scarlet, Indofast Violet Lake B, Indofast Brilliant Scarlet and Indofast Orange, and the like dispersed in a film forming polymeric binder. Selenium, selenium alloy, benzimidazole perylene, and the like and mixtures thereof may be formed as a continuous, homogeneous photogenerating layer. Benzimidazole perylene compositions are well known and described, for example in U.S. Pat. No. 4,587,189, the entire disclosure thereof being incorporated herein by reference. Multi-photogenerating layer compositions may be utilized where a photoconductive layer enhances or reduces the properties of the photogenerating layer. Examples of this type of configuration are described in U.S. Pat. No. 4,415,639, the entire disclosure of this patent being incorporated herein by reference. Other suitable charge generation materials known in the art may also be utilized, if desired. Charge generating binder layer including particles or layers including a photoconductive material such as vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof are especially preferred because of their sensitivity to white light. Vanadyl phthalocyanine, metal free phthalocyanine and tellurium alloys are also preferred because these materials provide the additional benefit of being sensitive to infrared light.

Numerous inactive resin materials may be employed in the photogenerating binder layer including those described, for example, in U.S. Pat. No. 3,121,006, the entire disclosure of which is incorporated herein by reference. Typical organic resinous binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, and the like. These polymers may be block, random or alternating copolymers.

The charge generation layer containing photoconductive compositions and/or pigments and the resinous binder material generally ranges in thickness of from about 0.1 micrometer to about 5.0 micrometers, and preferably has a thickness of from about 0.3 micrometer to about 3 micrometers. The charge generation layer thickness is related to binder content. Higher binder content compositions generally require thicker layers for photogeneration. Thicknesses outside these ranges can be selected providing the objectives of the present invention are achieved.

Any suitable and conventional techniques may be utilized to mix and thereafter apply the charge generating layer coating mixture to the hole blocking layer. Typical application techniques include extruding spraying, dip coating, roll coating, wire wound rod coating, and the like. Drying of the deposited coating may be effected by any suitable conventional technique such as oven drying, infra red radiation drying, air drying and the like.

Charge Transport Layer

Any suitable active charge transport layer may be applied to the charge generating layer. The active charge transport layer may comprise an activating compound useful as an additive dispersed in electrically inactive polymeric materials making these materials electrically active. These compounds may be added to polymeric materials which are incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active layer in order to discharge the surface charge on the active layer.

In particular, the active charge transport layer may comprise any suitable transparent organic polymer or non-polymeric material capable of supporting the injection of photo-generated holes and electrons from the trigonal selenium binder layer and allowing the transport of these holes or electrons through the organic layer to selectively discharge the surface charge. The active charge transport layer not only serves to transport holes or electrons, but also protects the photoconductive layer from abrasion or chemical attack and therefor extends the operating life of the photoreceptor imaging member. Thus, the active charge transport layer is a substantially non-photoconductive material which supports the injection of photogenerated holes from the generation layer. The active transport layer is normally transparent when exposure is effected through the active layer to ensure that most of the incident radiation is utilized by the underlying charge carrier generator layer for efficient photogeneration.

The charge transport layer forming mixture preferably comprises an aromatic amine compound. The substituents should be free form electron withdrawing groups such as $NO_2$ groups, CN groups, and the like Typical aromatic amine compounds include triphenylmethane, bis(4-diethylamine-2-methylphenyl)phenylmethane; 4'-4"bis (diethylamino)-2', 2"-dimethyltriphenylmethane, N,N'-bis (alkylphenyl)-[1,1'biphenyl]-4,4'-diamine wherein the alkyl is, for example, methyl, ethyl, propyl, n-butyl, etc., N,N,'-diphenyl-N,N,'-bis(chlorophenyl)-[1,1 '-biphenyl]-4,4'-diamine, N,N'-diphenyl-N,N,'bis(3"-methylphenyl)-(1,1'-biphenyl)-4,4'-diamine, and the like dispersed in an inactive resin binder.

Generally, the thickness of the transport layer is between about 5 micrometers and about 100 micrometers, but thicknesses outside this range can also be used. The hole transport layer should be an insulator to the extent that the electrostatic negative charge placed on the hole transport layer is not conducted in the absence of illumination at a rate sufficient to prevent formation and retention of an electrostatic latent image thereon. In general, the ratio of the thickness of the hole transport layer to the charge generator layer is preferably maintained from about 2:1 to about 200:1 and in some instances as great as about 400:1.

Writing an Image

In an example of writing an image, a laser beam (imaging light) is used to generate hole and electron pairs in the charge generator layer. The holes are transported through the hole transport layer to the surface to discharge negative charges on an organic photoconductor surface thus creating a latent image. The latent image will later attract toner and form an image. The electrons are conducted through the blocking layer to the conductive layer.

In an embodiment, the $TiO_2$ in the blocking layer have a particle size smaller than about 30% of the wavelength of the imaging light. In another embodiment, the $TiO_2$ in the blocking layer has a particle size smaller than about 10% of the wavelength of the imaging light. The dispersion of small diameter $TiO_2$ particles are, in general, better. A good $TiO_2$ dispersion can enable more uniform distribution of the salts between the $TiO_2$ particles to better assist the transport of electrons between the $TiO_2$ particles. Without the presence of salts between the $TiO_2$ particles, electrons can often get trapped at the interfaces between the $TiO_2$ particles and the binder polymers. The trapped electrons can produce high electrical fields and cause injections of holes through the blocking layer into to the photoconductor.

Chemistry Definitions

The term "alkyl" includes saturated aliphatic groups, including straight-chain alkyl groups, branched-chain alkyl groups, cycloalkyl (alicyclic) groups, alkyl substituted cycloalkyl groups, and cycloalkyl substituted alkyl groups. The term alkyl further includes alkyl groups which can further include oxygen, nitrogen, sulfur or phosphorous atoms replacing one or more carbons of the hydrocarbon backbone. In an embodiment, a straight chain or branched chain alkyl has 10 or fewer carbon atoms in its backbone (e.g., $C_1$–$C_{10}$ for straight chain, $C_3$–$C_{10}$ for branched chain), and more preferably 6 or fewer. Likewise, preferred cycloalkyls have from 4–7 carbon atoms in their ring structure, and more preferably have 5 or 6 carbons in the ring structure.

Moreover, the term alkyl includes both "unsubstituted alkyls" and "substituted alkyls", the latter of which refers to alkyl moieties having substituents replacing a hydrogen on one or more carbons of the hydrocarbon backbone.

The term "aryl" includes groups, including 5- and 6-membered single-ring aromatic groups that may include from zero to four heteroatoms. Furthermore, the term "aryl" includes multicyclic aryl groups, e.g., tricyclic, bicyclic, e.g., naphthalene, benzoxazole, and benzodioxazole. Those aryl groups having heteroatoms in the ring structure may also be referred to as "aryl heterocycles", "heterocycles," "heteroaryls" or "heteroaromatics". The aromatic ring can be substituted at one or more ring positions with such substituents as described above including alkyls. Aryl groups can also be fused or bridged with alicyclic or heterocyclic rings which are not aromatic so as to form a polycycle (e.g., tetralin).

The term "alkenyl" includes unsaturated aliphatic groups analogous in length and possible substitution to the alkyls described above, but that contain at least one double bond. The term further includes alkenyl groups which include oxygen, nitrogen, sulfur or phosphorous atoms replacing one or more carbons of the hydrocarbon backbone. Moreover, the term alkenyl includes both "unsubstituted alkenyls" and "substituted alkenyls", the latter of which refers to alkenyl moieties having substituents replacing a hydrogen on one or more carbons of the hydrocarbon backbone.

The term "alkynyl" includes unsaturated aliphatic groups analogous in length and possible substitution to the alkyls described above, but which contain at least one triple bond. The term further includes alkynyl groups which include oxygen, nitrogen, sulfur or phosphorous atoms replacing one or more carbons of the hydrocarbon backbone. Moreover, the term alkynyl includes both "unsubstituted alkynyls" and "substituted alkynyls", the latter of which refers to alkynyl moieties having substituents replacing a hydrogen on one or more carbons of the hydrocarbon backbone.

The term "amine" or "amino" includes compounds where a nitrogen atom is covalently bonded to at least one carbon or heteroatom. The term "alkyl amino" includes groups and compounds wherein the nitrogen is bound to at least one additional alkyl group. The term "dialkyl amino" includes groups wherein the nitrogen atom is bound to at least two additional alkyl groups. The term "arylamino" and "diarylamino" include groups wherein the nitrogen is bound to at least one or two aryl groups, respectively. The term "alkylarylamino," "alkylaminoaryl" or "arylaminoalkyl" refers to an amino group which is bound to at least one alkyl group and at least one aryl group. The term "alkaminoalkyl" refers to an alkyl, alkenyl, or alkynyl group bound to a nitrogen atom which is also bound to an alkyl group.

The term "amide" or "aminocarboxy" includes compounds or moieties which contain a nitrogen atom which is bound to the carbon of a carbonyl or a thiocarbonyl group. The term includes "alkaminocarboxy" groups which include alkyl, alkenyl, or alkynyl groups bound to an amino group bound to a carboxy group. It includes arylaminocarboxy groups which include aryl or heteroaryl moieties bound to an amino group which is bound to the carbon of a carbonyl or thiocarbonyl group. The terms "alkylaminocarboxy," "alkenylaminocarboxy," "alkynylaminocarboxy," and "arylaminocarboxy" include moieties wherein alkyl, alkenyl, alkynyl and aryl moieties, respectively, are bound to a nitrogen atom which is in turn bound to the carbon of a carbonyl group.

The terms "polycyclyl" or "polycyclic radical" include moieties with two or more rings (e.g., cycloalkyls, cycloalkenyls, cycloalkynyls, aryls and/or heterocyclyls) in which two or more carbons are common to two adjoining rings, e.g., the rings are "fused rings". Rings that are joined through non-adjacent atoms are termed "bridged" rings. Each of the rings of the polycycle can be substituted with such substituents including alkyl as described above.

The term "heteroatom" includes atoms of any element other than carbon or hydrogen. Preferred heteroatoms are nitrogen, oxygen, sulfur and phosphorus.

The term "heterocycle" or "heterocyclic" includes saturated, unsaturated, aromatic ("heteroaryls" or "heteroaromatic") and polycyclic rings which contain one or more heteroatoms. Examples of heterocycles include, for example, benzodioxazole, benzofuran, benzoimidazole, benzothiazole, benzothiophene, benzoxazole, deazapurine, furan, indole, indolizine, imidazole, isooxazole, isoquinoline, isothiaozole, methylenedioxyphenyl, napthridine, oxazole, purine, pyrazine, pyrazole, pyridazine, pyridine, pyrimidine, pyrrole, quinoline, tetrazole, thiazole, thiophene, and triazole. Other heterocycles include morpholine, piprazine, piperidine, thiomorpholine, and thioazolidine. The heterocycles may be substituted or unsubstituted.

The term "ring" includes aryl rings, cycloalkyl rings, polycyclic rings, and heterocyclic rings. Examples of rings include imidazole, benzene, and cyclohexane.

The invention is further illustrated by the following examples, which should not be construed as further limiting. The contents of all references, pending patent applications and published patents, cited throughout this application are hereby expressly incorporated by reference.

Those skilled in the art will recognize, or be able to ascertain using no more than routine experimentation, many equivalents to the specific embodiments and methods described herein. Such equivalents are intended to be encompassed by the scope of the following claims.

EXAMPLES

Example 1

A charge blocking layer was fabricated from a coating dispersion consisting of 70 weight percent of $TiO_2$ and 30 weight percent of phenolic binder composition. The charge blocking layer coating dispersion was prepared by dispersing 23.3 grams of needle shaped $TiO_2$ particles (STR60N, available from Saikai Chemical Co.) into a solution of 10 grams linear phenolic binder composition, VARCUM® 29112 (available from OxyChem) dissolved in 75 grams of xylene and n-butanol solvent mixture at a one to one weight ratio. This dispersion was milled in an attritor (Szegvari attritor system, available from Union Process Co. ) with zirconium balls having a diameter of 0.4 millimeter for 4 hours. The average $TiO_2$ particle size in the dispersion solution was measured to be about 0.12 micrometer. The $TiO_2$ dispersion was then added with 0.005 gm of Adogen 464. The dispersion was then rolled for 24 hours. The resulting dispersion was then dip coated onto a smooth surface aluminum drum substrate of 30 mm diameter and dried at a temperature of 150 degrees C. for 30 minutes to form a blocking layer. The dried blocking layer coating was very uniform and hazy. The dried blocking layer film has a thickness of about 3 micrometers.

A charge generation coating dispersion was prepared by dispersing 22 grams of chloride gallium phthalylene particles having an average particle size of about 0.4 micrometers into a solution of 10 grams VMCH (available from Union Carbide Co.) dissolved in 368 grams of xylene and n-butanol solvent mixture at one to one weight ratio. VMCH was composed of 86% by weight vinyl chloride, 13% by weight vinyl acetate, and 1% by weight maleic acid, where the VMCH has a molecular weight of about 27,000. This dispersion was milled in a dynomill mill (KDL, available from GlenMill) with zirconium balls having a diameter of 0.4 millimeter for 4 hours. The drum with the charge blocking layer coating was dipped in the charge generation coating dispersion and withdrawn at a rate of 20 centimeters per minute. The resulting coated drum was air dried to form a 0.5 micrometer thick charge generating layer.

A charge transport layer coating solution was prepared containing 40 grams of N,N,'-diphenyl-N,N,'-bis(3-methylphenyl)-(1,1'-biphenyl)-4,4'-diamine and 60 grams of poly(4,4'-diphenyl-1,1'-cyclohexane carbonate) (PCZ 400 available from Mitsubishi Chemical Co.) dissolved in a solvent mixture containing 80 grams of monochlorobenzene and 320 grams of tetrahydrofuran. The charge transport coating solution was applied onto the coated drum by dipping the drum into the charge transport coating solution and withdrawn at a rate of 150 centimeters per second. The coated drum was dried at 110° C. for 20 minutes to form a 20 micrometer thick charge transport layer.

The resulting photoreceptor drum was electrical tested in a cyclic scanner. The photorecptor was charged to negative 700 volt and discharged by exposing to a 670 nm Light emitted diode. The discharged voltage was 70 volt.

Example 2

The process described in Example 1 was repeated except that the blocking layer was not doped with the Adogen salts. The resulting photoreceptor was electrical tested. The discharged voltage was 100V.

Other modifications of the present invention may occur to those skilled in the art based upon a reading of the present disclosure and these modifications are intended to be included within the scope of the present invention.

What is claimed is:

1. An electrographic photosensitive material comprising a blocking layer, a charge transport layer, an electroconductive substrate layer and a charge generation layer, wherein the blocking layer comprises $TiO_2$ with an average particle size less than about 50 nm and a quaternary ammonium salt, and wherein the quaternary ammonium salt is uniformly distributed in the blocking layer and is less than about 5 wt % of the blocking layer.

2. The electrographic photosensitive material of claim 1, wherein the $TiO_2$ comprises less than about 70 wt % of the total solids content of the blocking layer.

3. The electrographic photosensitive material of claim 1, wherein the quaternary ammonium salt is greater than about 0.08 wt % and less than about 0.1 wt % of the blocking layer.

4. The electrographic photosensitive material of claim 1, wherein the quaternary ammonium salt is selected from the group consisting of salts containing long chain alkyl groups and salts containing polymeric structures.

5. The electrographic photosensitive material of claim 1, wherein the $TiO_2$ is rutile-type $TiO_2$.

6. The electrographic photosensitive material of claim 1, wherein the blocking layer is in direct contact with the substrate layer.

7. The electrographic photosensitive material of claim 1, wherein the blocking layer further comprises a phenolic resin binder.

8. The electrographic photosensitive material of claim 1, wherein the quaternary ammonium salt is Calgon 261-LV.

9. The electrographic photosensitive material of claim 1, wherein the quaternary ammonium salt is a methyltrialkyl ($C_8$–$C_{10}$)-ammonium halide.

10. The electrographic photosensitive material of claim 9, wherein the methyltrialkyl ($C_8$–$C_{10}$)-ammonium halide is present in the blocking layer at a concentration of between about 400 and about 1000 ppm.

11. An electrographic photosensitive material comprising a blocking layer, wherein the blocking layer comprises $TiO_2$ with an average particle size of about 10 nm to about 300 nm, and a quaternary ammonium salt, and wherein the quaternary ammonium salt is greater than about 0.08 wt % and less than about 1 wt % of the blocking layer.

12. The electrographic photosensitive material of claim 11, wherein the quaternary ammonium salt is selected from the group consisting of salts containing long chain alkyl groups and salts containing polymeric structures.

13. The electrographic photosensitive material of claim 11, wherein the $TiO_2$ is rutile-type $TiO_2$.

14. The electrographic photosensitive material of claim 11, wherein the $TiO_2$ comprises less than about 70 wt % of the total solids content of the blocking layer.

15. The electrographic photosensitive material of claim 11, wherein the blocking layer further comprises a phenolic resin binder.

16. The electrographic photosensitive material of claim 11, wherein the quaternary ammonium salt is uniformly distributed in the blocking layer.

17. The electrographic photosensitive material of claim 11, wherein the quaternary ammonium salt is Calgon 261-LV.

18. The electrographic photosensitive material of claim 11, wherein the quaternary ammonium salt is a methyltrialkyl ($C_8$–$C_{10}$)-ammonium halide.

19. The electrographic photosensitive material of claim 18, wherein the methyltrialkyl ($C_8$–$C_{10}$)-ammonium halide is present in the blocking layer at a concentration of between about 400 and about 600 ppm.

20. An image forming apparatus for forming images on a recording medium comprising an imaging light having a wavelength and an organic photoreceptor having a blocking layer, an electroconductive substrate layer, and a charge generation layer, wherein the blocking layer comprises $TiO_2$ particles and a quaternary ammonium salt and wherein the quaternary ammonium salt is uniformly distributed in the blocking layer and is less than about 5 wt % of the blocking layer.

21. The image forming apparatus of claim 20, wherein the $TiO_2$ in the blocking layer has a particle size smaller than about 10% of the wavelength of the imaging light.

22. The image forming apparatus of claim 20, wherein the quaternary ammonium salt is selected from the group consisting of salts containing long chain alkyl groups and salts containing polymeric structures.

23. The image forming apparatus of claim 20, wherein the $TiO_2$ comprises less than about 70 wt % of the total solids content of the blocking layer.

24. The image forming apparatus of claim 20, wherein the quaternary ammonium salt is less than about 1 wt % of the blocking layer.

25. The image forming apparatus of claim 20, wherein the quaternary ammonium salt is greater than about 0.8 wt % and less than about 1 wt % of the blocking layer.

26. The image forming apparatus of claim 20, wherein the blocking layer is in direct contact with the substrate layer.

27. The image forming apparatus of claim 20, wherein the $TiO_2$ has an average particle size less than about 50 nm.

28. The image forming apparatus of claim 20, wherein the blocking layer further comprises a phenolic resin binder.

29. The electrographic photosensitive material of claim 20, wherein the quaternary ammonium salt is Calgon 261-LV.

30. The image forming apparatus of claim 20, wherein the quaternary ammonium salt is a methyltrialkyl ($C_8$–$C_{10}$)-ammonium halide.

31. The image forming apparatus of claim 30, wherein the methyltrialkyl ($C_8$–$C_{10}$)-ammonium halide is present in the blocking layer at a concentration of between about 400 and about 600 ppm.

* * * * *